US006186929B1

(12) United States Patent
Endelman et al.

(10) Patent No.: US 6,186,929 B1
(45) Date of Patent: Feb. 13, 2001

(54) REFORMER EXERCISE APPARATUS

(75) Inventors: Ken Endelman, Sacramento, CA (US); Brian Janowski, Gwinn, MI (US)

(73) Assignee: Balanced Body, Inc., Sacramento, CA (US)

( * ) Notice: Under 35 U.S.C. 154(b), the term of this patent shall be extended for 0 days.

(21) Appl. No.: 09/275,755

(22) Filed: Mar. 25, 1999

Related U.S. Application Data

(63) Continuation-in-part of application No. 09/266,286, filed on Mar. 11, 1999.

(51) Int. Cl.[7] ..... A63B 21/02

(52) U.S. Cl. ..... 482/121; 482/71; 482/72; 482/123; 482/101; 482/133; 482/135

(58) Field of Search ..... 482/71, 72, 54, 482/101, 95, 96, 121–123, 129–130, 132–136, 142

(56) References Cited

U.S. PATENT DOCUMENTS

| | | |
|---|---|---|
| 339,638 | 4/1886 | Goldie . |
| D. 354,780 | 1/1995 | Endelman . |
| D. 354,781 | 1/1995 | Endelman . |
| D. 362,700 | 9/1995 | Breibart et al. . |
| 1,621,477 | 3/1927 | Pilates . |
| 1,738,987 | 12/1929 | Dattilo . |
| 1,750,549 | 3/1930 | Thomson et al. . |
| 1,979,783 | 11/1934 | Williams et al. . |
| 1,980,036 | 11/1934 | Casler et al. . |
| 2,733,922 | 2/1956 | Diego . |
| 3,261,606 | 7/1966 | Elia et al. . |
| 3,586,322 | 6/1971 | Kverneland . |
| 3,770,267 | 11/1973 | McCarthy . |
| 3,892,815 | 7/1975 | Martucci . |

(List continued on next page.)

FOREIGN PATENT DOCUMENTS

| | | |
|---|---|---|
| 1470421 | 1/1967 | (FR) . |
| 2625907 | 7/1989 | (FR) . |

*Primary Examiner*—Jerome W. Donnelly
*Assistant Examiner*—Lori Baker Amerson
(74) *Attorney, Agent, or Firm*—Merchant & Gould P.C.; John R. Wahl

(57) ABSTRACT

An exercise apparatus comprises a generally rectangular extruded aluminum frame having a head end and a foot end and including a pair of spaced apart parallel track members wherein the head end, the foot end, and the track or rail members are each formed from the same metal extrusion material and have the same cross sectional shape. The apparatus includes a movable carriage mounted on the frame for movement along the rail members between the head and foot ends against one or more resistance members connected between the carriage and the foot end of the frame. Each of the rail members includes an outwardly open T shaped longitudinal slot therein for receiving a T shaped anchor bar for a foot support bar assembly. The foot bar assembly includes a replaceable U shaped foot bar having a pair of spaced parallel leg portions. The assembly accommodates various shapes of foot bars. The leg portions are telescopically joined to support members pivotally mounted to a support bracket assembly. Each bracket assembly has an elongated anchor bar member slidably disposed in the slot in the rail member. The bracket assembly also permits the foot bar to be rotated between various positions above the plane of the carriage and rotated to a horizontal position around the foot end for storage. The rail members and head and foot end members are each a metal extrusion comprising a closed middle portion, an outer T shaped slot portion, and an inner C shaped support channel portion. The support rollers are captured in the support channel portion of the rail members and roll on the bottom wall of the extrusion. The guide rollers extend into the support channel portion and roll against vertical rib of the extrusion rail member. The invention further includes laterally adjustable shoulder stops on the carriage and arm support posts that are removable and storable on the frame so that the apparatus may be compactly stored.

26 Claims, 14 Drawing Sheets

U.S. PATENT DOCUMENTS

| | | |
|---|---|---|
| 4,084,815 | 4/1978 | Flannery . |
| 4,272,074 | 6/1981 | Sferele . |
| 4,383,684 | 5/1983 | Schliep . |
| 4,700,945 | 10/1987 | Rader . |
| 4,706,953 | 11/1987 | Graham . |
| 4,768,776 | 9/1988 | Giannotti . |
| 4,884,802 | 12/1989 | Graham . |
| 4,911,438 | 3/1990 | Van Straaten . |
| 4,974,832 | 12/1990 | Dalebout . |
| 5,024,214 | 6/1991 | Hayes . |
| 5,066,005 | 11/1991 | Luecke . |
| 5,263,913 | 11/1993 | Boren . |
| 5,338,278 | 8/1994 | Endelman . |
| 5,364,327 | 11/1994 | Graham . |
| 5,607,381 | 3/1997 | Endelman . |
| 5,653,670 | 8/1997 | Endelman . |
| 5,681,249 | 10/1997 | Endelman . |
| 5,807,217 | 9/1998 | Endelman . |

REFORMER EXERCISE APPARATUS

CROSS REFERENCE TO RELATED APPLICATIONS

This application is a continuation in part of U.S. patent application Ser. No. 09/266,286, filed Mar. 11, 1999, which is hereby incorporated by reference in its entirety.

BACKGROUND OF THE INVENTION

1. Field of the Invention

This invention relates generally to the field of exercise equipment in which a movable carriage is utilized to at least partially support a user's body, commonly referred to as a "reformer", and more particularly to a compact lightweight reformer.

2. Description of the Related Art

Joseph H. Pilates, in U.S. Pat. No. 1,621,477, originally developed the concept of using a wheeled platform carriage connected to a resistance device such as a set of weights in conjunction with a stationary frame to provide a variable resistance against which a user could push with his/her feet or pull with the arms while in a sitting or recumbent position in order to exercise the major muscle groups of the user's trunk, legs and/or arms. Since that time many changes and improvements in the design of such an apparatus were developed by Joseph Pilates, and more recently, have been evolved by his students and others. U.S. Pat. No. 5,066,005 and my patents referred to above are representative of the current state of evolutionary development of these changes that have taken place since 1927.

The current conventional "reformer" type apparatus includes a wheeled platform carriage which rides on a rectangular wooden or metal frame. The above referenced patent disclose examples of wood framed reformers. An example of a metal frame reformer is disclosed in U.S. Pat. No. 5,792,033 to Merrithew. The carriage which rides on the frame is connected to a series of parallel springs or elastic members which are in turn connected to a foot end of the rectangular frame. The carriage typically rides on parallel rails or tracks typically mounted to the inside of the longer sides of the rectangular frame. This carriage has a flat, padded upper surface and typically includes a pair of spaced, padded, upright shoulder stops and a head rest at one end to support the shoulders and head of the user when he/she is reclined on the carriage. An adjustable foot bar, foot support, or foot rest against which the user places his/her feet is mounted to the foot end of the rectangular frame. A spring support rod is positioned across the foot end between the tracks by a spring support bracket fastened to the frame. The rod typically fits in one of three or four recesses or slots in the support bracket, depending on the size or ability of the user. Alternatively, the spring support rod may be permanently fastened to the frame. The user can then push against the foot rest to move the carriage along the track away from the foot rest against spring tension to exercise the leg and foot muscle groups in accordance with prescribed movement routines. The carriage is prevented from moving close to the foot rest by a stop pin typically fastened to the top of each track, against which the carriage abuts when the carriage is at rest. The maximum limit of carriage travel is provided by the head rest abutting the head end wall of the frame.

U.S. Pat. Nos. 5,338,276, 5,607,381 and 5,681,249 disclose reformers and several foot rest arrangements and adjustable head rest assemblies for this type of exercise apparatus. One of the difficulties which the currently available reformers do not optimally address is the portablilty and storability of the apparatus. Accordingly there is a need for a reformer type of exercise apparatus that can be efficiently stored and transported without sacrificing such features as having an adjustable carriage and spring arrangement to accommodate extremes in physical body sizes as well as optimally position the carriage with respect to the foot rests for user's within the normal body size range. Another problem with the conventional design of reformers is that the reformer is relatively bulky, heavy, and takes up a substantial amount of floor area even when not in use. Most reformers have a footprint of about two feet by seven or eight feet. Therefore, in a class or studio setting a substantial amount of floor space must be allocated totally to the reformers. There is therefore a need for a reformer that can be compactly moved and stored when not in use.

Often a user may wish to take the reformer to different locations. Unfortunately for this purpose, most reformers currently available are heavy and are not designed to be easily transported. There is therefore also a need for a full performance reformer that has a frame design that can be easily dismantled and transported by one person and easily assembled for use.

In some situations the movable carriage on conventional reformers may tend to tilt upward from the rails upon which the carriage rides, as when a user improperly stands with one foot on the edge of the carriage and one foot on the frame. Accordingly there is also a need for a reformer apparatus that inherently securely retains the carriage on the tracks or rails while simultaneously permitting guided free movement of the carriage along the rails against spring tension.

SUMMARY OF THE INVENTION

The reformer exercise apparatus in accordance with the present invention addresses the above identified limitations in conventional reformer designs. The present invention is an exercise apparatus which comprises a wheeled carriage having a generally flat top surface. The carriage is movably mounted on parallel track members of a generally rectangular frame which has a head end and a foot end. The carriage has a pair of upwardly extending shoulder stops mounted thereto at one end and a head rest between the shoulder stops that extends outward from the carriage toward the head end of the frame. A plurality of elastic members may be selectively connected between the foot end of the frame and the carriage to elastically bias the carriage toward the foot end of the frame.

The frame primarily comprises a pair of metal extrusion rail members spaced in parallel relation by a foot end support member and a head end support member. A pair of upright arm extensions are secured to the head end support member at the head end of each of the rails. A spring support bracket integral with the foot end support member is used to fasten one end of each of a plurality of springs.

The head end of the frame supports a pair of upright pulley support arms to which are fastened rope pulleys to permit the carriage to travel against spring tension the full length of the parallel tracks by the user pulling ropes fastened to the carriage and running through the pulleys.

The rail members of the frame are comprised of a single metal extrusion having a closed mid portion, an inner guide/support channel portion, and an outer T slot portion. The frame may be formed in two removable sections, a head section and a foot section, to create a highly transportable and compact exercise apparatus. The two sections are joined by bayonet type tongues which fit within the mid portions of the extrusion of the other section of the rail members.

The carriage assembly is captured between the rail members by a roller wheel and guide roller assembly in which four roller wheels ride in a guide/support channel in the extrusion rail members to hold the carriage onto the rails. The guide rollers ride in the same channel as the support roller wheels but engage the vertical wall of the support channel to prevent binding of the carriage on the rail members and minimize friction between the carriage and the rails.

The foot bar assembly is a generally U shaped bar member which is supported by a support bracket assembly which slides in the T slot of the rail members and includes both horizontal and vertical foot bar positions along with various angular positions permitting the foot bar to be selectively positioned in a plurality of vertical positions from the carriage and the foot end of the frame.

Other objects, features and advantages of the present invention will become apparent from a reading of the following detailed description when taken in conjunction with the accompanying drawing wherein a particular embodiment of the invention is disclosed as an illustrative example.

DETAILED DESCRIPTION OF THE INVENTION

Figure 1:
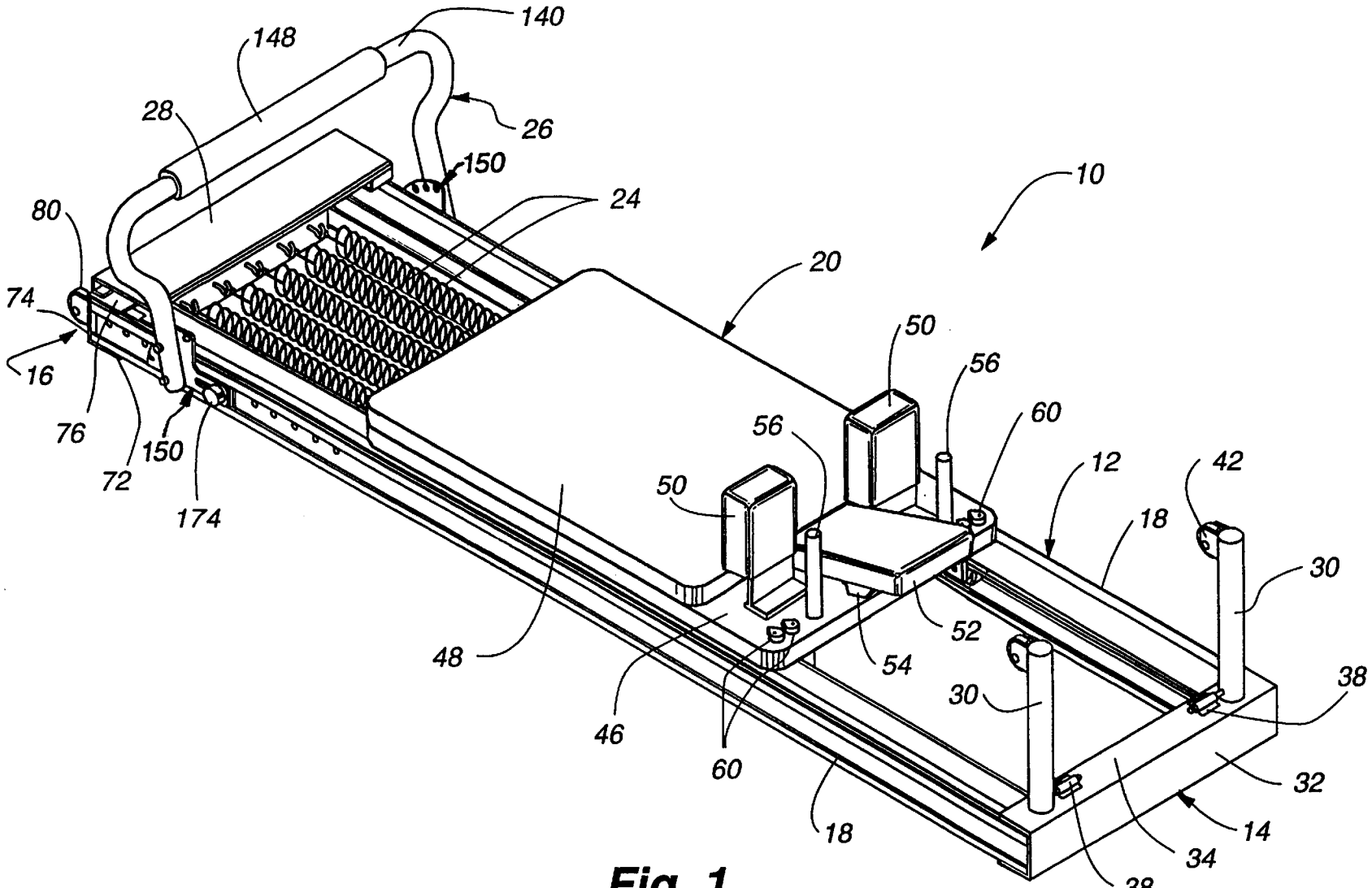
FIG. 1 is an upper perspective view of a first embodiment of the reformer exercise apparatus in accordance with the present invention with the carriage shown in a partially tensioned position away from the spring anchor assembly at the foot end of the frame.
Figure 2:
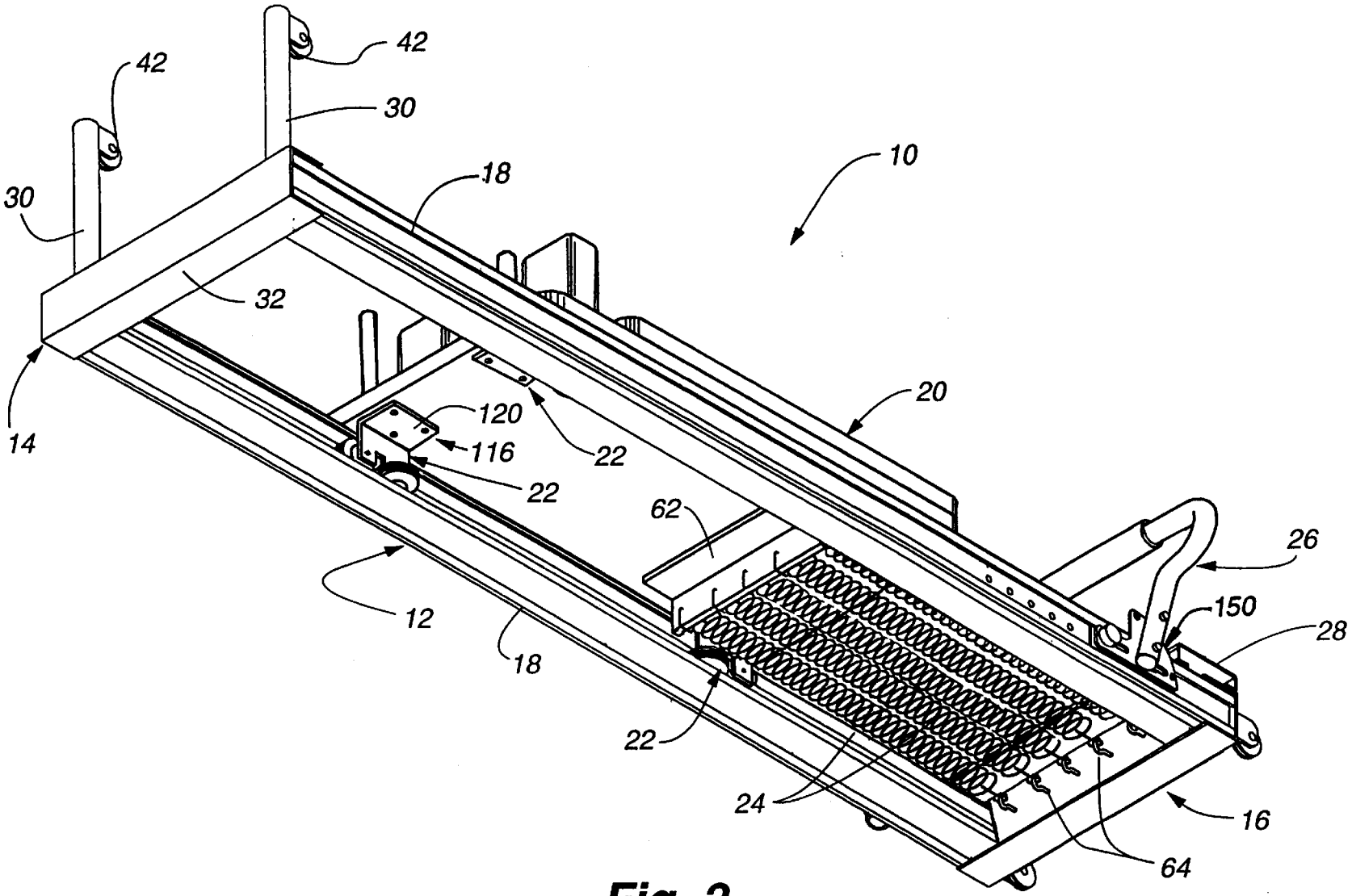
FIG. 2 is a bottom perspective view of the reformer exercise apparatus shown in FIG. 1.

An exercise apparatus 10 in accordance with a first embodiment of the present invention is shown in upper and lower perspective views in FIGS. 1 and 2 respectively. The exercise apparatus 10 comprises a generally rectangular frame 12 having a head end 14 and a foot end 16 and a pair of parallel track or rail members 18 separating the head end 14 from the foot end 16.

A movable carriage 20 rides on four roller wheel assemblies 22 fastened to the underside of the carriage 20. These wheel assemblies 22 roll on the track members 18 to support and guide movement of the carriage 20 back and forth along the track members 18 of the frame 12. A plurality of elastic members, e.g., springs 24 are selectively connected between the carriage 20 and the foot end 16 to bias the carriage 20 toward the foot end 16.

A foot bar assembly 26 is removably fastened to the frame 12 near the foot end 16 so as to provide a stationary support for a user to push against in order to move the carriage 20 back and forth along the track members 18. The foot end 16 also includes a flat foot platform 28 for a user to place one foot on while the other foot is placed on the carriage 20 for standing exercises on the apparatus 10.

The head end 14 is designed to space the rail members 18 rigidly apart and also support a pair of removable arm posts 30. The head end 14 is preferably a rectangular box tubular extrusion member 32 made preferably of aluminum permanently fastened to the head ends of the rail members 18. The extrusion member 32 has a cutout at each end to receive the head end of each of the rail members 18. The top side 34 of the tubular box extrusion member 32 as an aperture therethrough aligned with a corresponding vertical bore through the head end of each of the rail members 18. The aperture in the extrusion member 32 and the bores through the rail members 18 form a pair of sockets 36, as best shown in the exploded view of FIG. 9, for receiving the bottom ends of the arm members 30. A latch pin assembly 38 mounted on the top 34 of the head end extrusion member 32 adjacent each arm member 30 secures the arm members 30 in the sockets 36 by the pin sliding horizontally into a mating hole 40 formed in the lower portion of the arm member 30. The upper end of each of the arm members 30 supports a pulley assembly 42. The pulley assemblies 42 in turn each has a hand cord 44, as shown in FIG. 10, threaded therethrough which is fastened to the carriage 20.

Referring back to FIGS. 1 and 2, the carriage 20 comprises a flat support platform 46 which has a generally rectangular shape. A cushion pad 48 is secured to an upper surface of the platform 46. A pair of shoulder stops 50 are spaced apart near one end of and fastened to the rectangular platform 46. These shoulder stops 50 engage with a user's shoulders when the user lies on his or her back on the carriage 20 while exercising on the apparatus 10. A padded head rest 52 is fastened via a hinge at a base end to the plate 46 between the shoulder stops 50. A trapezoidal shaped hinged block 54 is fastened to the underside of the head rest permitting a user to adjust the incline of the head rest 52 between three positions. A pair of upright posts 56 on either side of the head rest 52 provide a parking spot for the hand grip loop 58 at one end of each of the hand cords 44 (see FIG. 10) when they are not in use. The other ends of the cords 44 are adjustably locked between cam lock rollers 60.

Referring specifically to FIG. 2, an elongated spring support or anchor angle bracket 62 is fastened to the underside of the platform 46. To this bracket 62 are fastened one end of each of the springs 24. The other end of each of the springs 24 may be selectively fastened to either a hook 64 projecting from the vertical side of the end wall member 16 or around an upright spool shaped post 66 (see FIG. 6) fastened to the upper surface of the end wall member 16.

The end wall member 16 includes an elongated metal tubular extrusion 68, preferably aluminum, which has a rectangular cross section, made up of a head wall 70, a bottom wall 72, a foot wall 74, and a top wall 76. A portion of each end of the head wall 70 of the tubular extrusion 68 is cut away forming a pair of recessed areas, each sized to receive the foot end of one of the track members 18. The track members 18 are fastened in the recesses to the extrusion 68 by welding, adhesive bonding or other suitable means. The vertical head wall 70 of the extrusion 68 has a plurality of hooks projecting toward the carriage 20. These hooks 64 are positioned to engage and anchor the foot ends of the springs 24 to the end wall 18. Similarly, the top wall 76 has the plurality of spindle shaped posts 66 mounted thereon which provide an alternate fastening point for the springs 24. The location of the hooks 64 on the vertical head wall provides a relaxed anchor for the springs 24 when the carriage 20 is fully retracted toward the foot end 16. The location of the posts 66 along the horizontal top wall 76 provides an alternative anchor point for the springs 24 which tensions the springs 24 and thus pre biases the carriage 20 toward the foot end 16 prior to a user exerting any force against the foot bar assembly 26.

Figure 4:
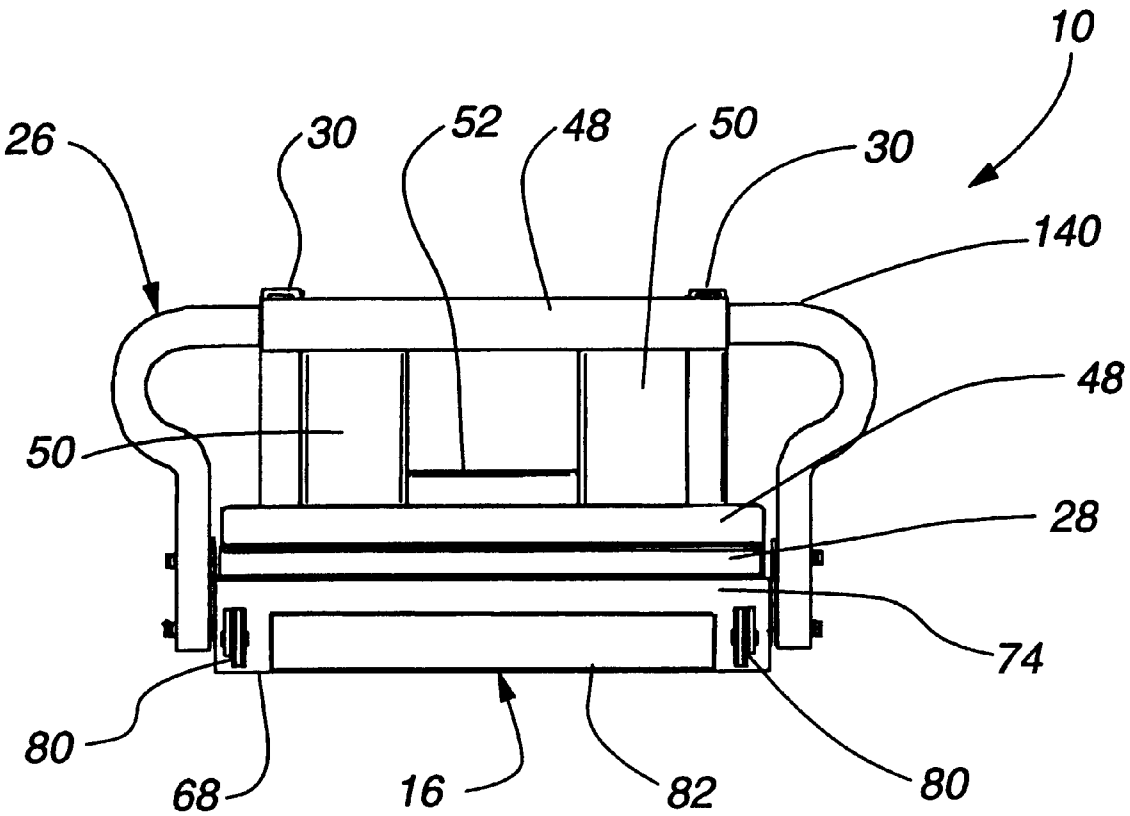
FIG. 4 is an end view of the foot end of the apparatus according to the present invention as shown by the line 4—4 in FIG. 3.

The foot end 16 further has the horizontal foot support platform 28 fastened to the top wall 76 of the extrusion 68. This platform 28 is preferably an elongated plate having bent sides to form a generally C shaped channel cross section. One of the sides, facing the carriage 20, includes a cutout 78 to permit the user to access, i.e., reach beneath and position springs 24 on the posts 66 as can be envisioned with reference to FIG. 6. As shown in the end view of FIG. 4, fastened to the vertical foot wall 74 of the extrusion 68 are a pair of wheel assemblies 80. These wheel assemblies 80 permit the apparatus 10 to be easily transported by simply lifting the head end 14 until the wheels engage the ground and then rolling the apparatus as one would roll a wheelbarrow. Finally, an upwardly open channel shaped plate 82 is fastened horizontally to the vertical foot wall 74 between the wheel assemblies 80. This plate 82 provides a slot to receive and support a bottom edge of a jump board 84 as shown in FIG. 10.

The track or rail members 18 are shown in cross sectional views in FIGS. 5–8. As particularly shown in FIG. 5, each track member 18 is preferably an aluminum extrusion 88 having a pair of spaced upright longitudinal ribs 90 and 92 forming a closed box mid section 94 between a generally flat top wall 96 and a generally flat bottom wall 98. The top wall 96 extends inward and ends in a downward extending curved portion 100. The top wall 96 further extends horizontally outward and terminates in a vertical upper outer wall 102. A longitudinal gusset 104 between the first rib 90 and the upper outer wall 102 forms a closed box channel 106 extending parallel to the mid section 94. The longitudinal gusset 104 reinforces the upper outer wall 102.

The bottom wall 98 extends horizontally outward to a longitudinally extending vertical lower outer wall 108. The outer wall 108 is vertically aligned with the upper outer wall 102. The top wall 96, bottom wall 98, upper outer wall 102 and lower outer wall 108 together form a longitudinally extending C shaped channel outer section extending parallel to the mid section 94. This outer section also may be viewed as forming shallow, longitudinally extending "T" shaped slot 110.

The bottom wall 98 also extends horizontally inward from the mid section 94 to a vertical inner wall 112 which is vertically aligned with the end of the curved end 100 of the top wall 96 of the extrusion 88 to form a C shaped inner section forming support/guide channel 114 which opens opposite to the C shaped outer section or slot 110. The support/guide channel 114 receives the wheel assemblies 22 as will be further described below.

Figure 8:
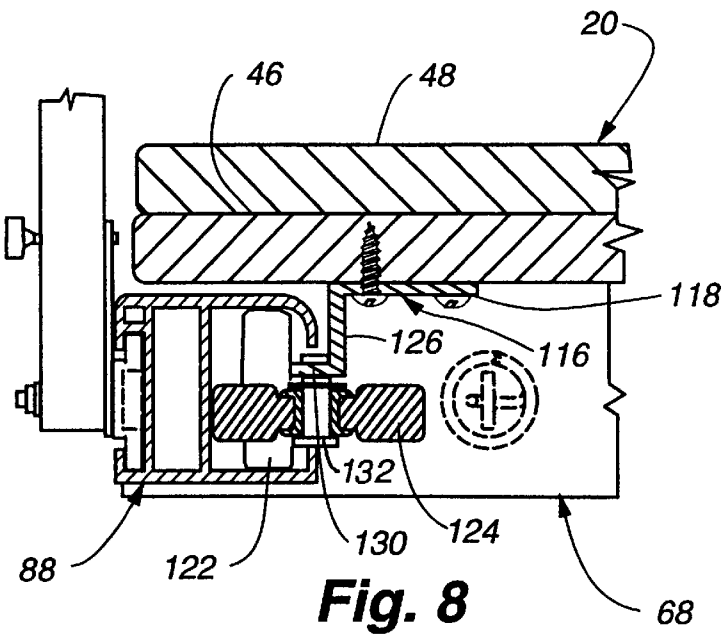
FIG. 8 is a sectional view of the apparatus shown in FIG. 3 taken along the line 8—8 in FIG. 3.

Referring now to FIG. 2 and sectional FIGS. 7 and 8, construction of the carriage 20 wheel assemblies 22 will be described. Each of the wheel assemblies 22 comprises a sheet metal support bracket 116 which has a horizontal mounting portion 118 fastened to the underside of the carriage platform 46 via screws 120, a bearing supported support roller wheel 122, and a bearing supported guide roller 124. The bracket 116 has a vertical mounting portion 126 bent downward at a right angle and extending vertically from the mounting portion 118, as is best shown in the sectional view of FIG. 7. A fixed axle 128 for the support roller 122 extends horizontally outward from the vertical mounting portion 126. The bracket 116 also has a guide roller portion support portion 130 which is bent at a right angle from the vertical mounting portion 126 so as to extend outward horizontally. A vertically extending guide roller axle 132 has its upper end fastened to the guide roller support portion 130. The lower end of the guide roller axle 132 passes through and is fastened to the roller bearing sleeve of the guide roller 122.

Figure 5:
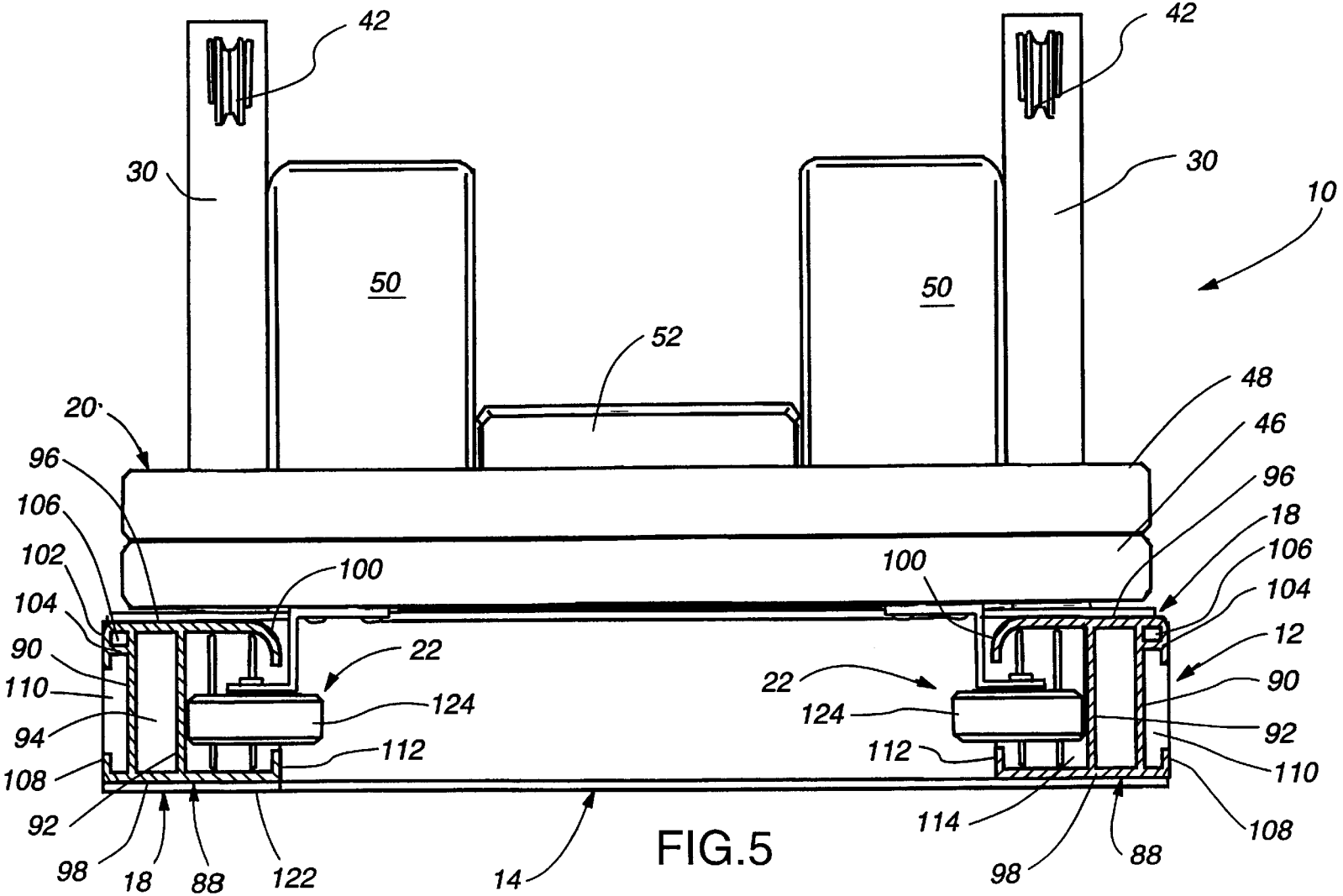
FIG. 5 is a sectional view of the apparatus shown in FIG. 3 taken along the line 5—5 in FIG. 3.
Figure 7:
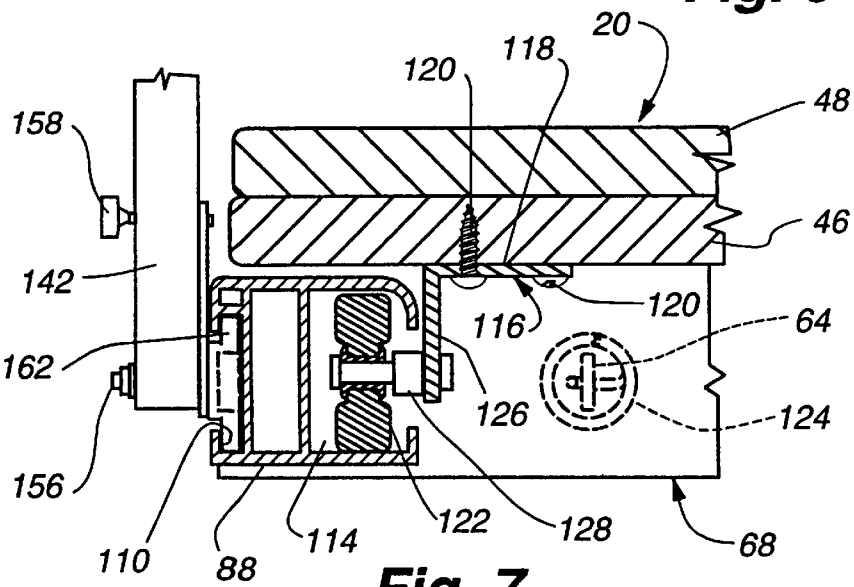
FIG. 7 is a sectional view of the apparatus shown in FIG. 3 taken along the line 7—7 in FIG. 3.

Referring now specifically to the sectional view of the apparatus 10 taken through the support roller wheel 122 shown in FIG. 7 and the sectional view of FIG. 5, this wheel 122 rides in the support channel 114 and carries one quarter of the weight of the carriage 20 and the user (not shown) as there are four wheel assemblies 22, each mounted adjacent a corner of the carriage platform 46. As best shown in FIGS. 5 and 8, the guide rollers 124 also ride in the support channel 114, but do not ride against the bottom wall 98 of the extrusion 88. Instead, the guide rollers 124 roll along the vertical longitudinal rib 92 of the extrusion 88 thus aligning the carriage 20 side to side on the rail members 18. These guide rollers 124 ensure that minimal friction is exerted between the carriage 20 and the rail members 18 for an exceptionally smooth back and forth movement of the carriage 20 on the rail members 16 of the apparatus 10 during use. Further, this arrangement, with both the support roller wheels 122 and the guide rollers 124 traveling in the guide channels 114 positively prevents the carriage 20 from tilting up or binding against the rail members 18 when a user does not properly distribute his or her weight symmetrically on the carriage 20. This configuration provides a unique safety feature to the present invention. The carriage 20 is, in essence, fastened to the rail members 18 at all times during normal operation of the apparatus 10. Further, when the head end 14 is lifted so as to engage the wheels 80 on the foot end 16 with the floor surface so that the apparatus 10 may be "wheelbarrowed" to a storage location, the carriage 20 remains fastened to the rail members 18. To facilitate such movement, a handle (not shown) may be fastened to the outer wall of the head end 14.

Figure 11:
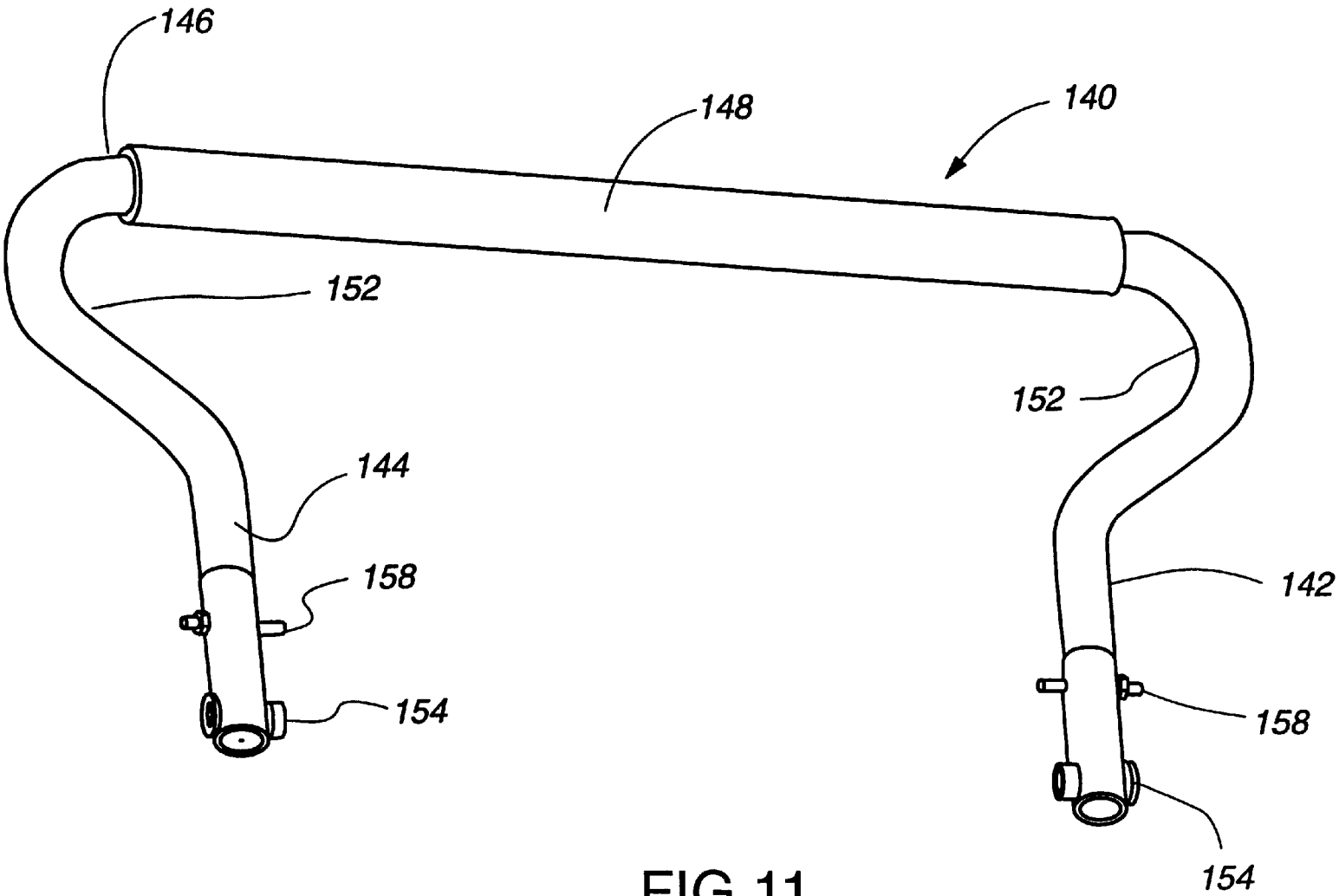
FIG. 11 is a separate perspective view of the foot bar in both embodiments of the apparatus in accordance with the present invention.
Figure 12B:
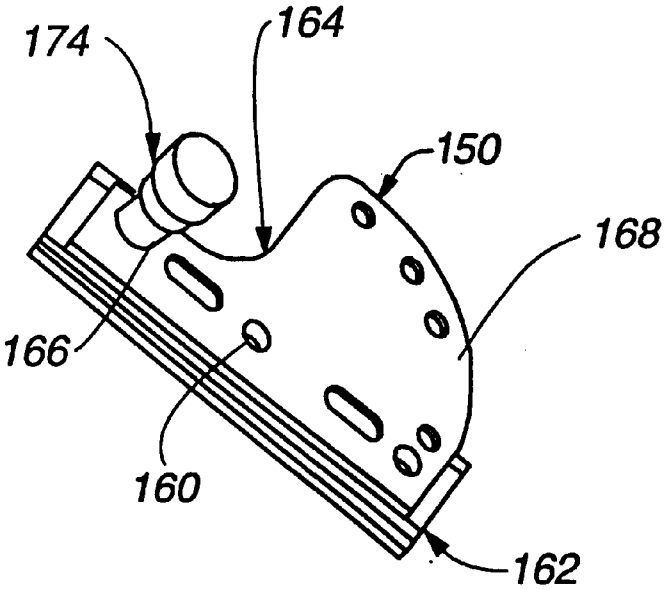
FIG. 12 is a separate perspective view of a pair of foot bar support bracket assemblies in accordance with the present invention.
Figure 12A:
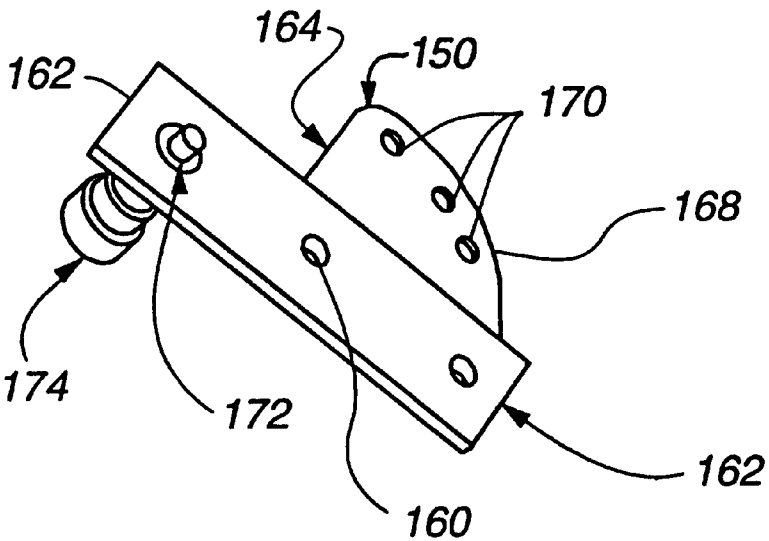

The foot bar assembly 26 comprises a generally U shaped foot bar 140, preferably made of tubular aluminum, having a pair of spaced parallel leg portions 142 and 144 and a foot bar portion 146 therebetween and a pair of adjustable support bracket assemblies 150. A padded sleeve 148 over the foot bar portion 146 provides a cushion support for a user's foot. The foot bar assembly 26 is shown in FIGS. 1–4, and 9 and 10 assembled onto the rail members 18 at the foot end 16 of the frame 12. FIGS. 11 and 12 show the foot bar 140 and support bracket assemblies 150 in perspective separated from the frame 12.

The foot bar portion 146 has an S shaped recurve region 152 at each end thereof joining the leg portions 142 and 144 so that the straight portion of the foot bar portion 146 extends fully across the rail members 18 and, when the foot bar 140 is rotated so as to lie horizontally over the foot end 16, the bar 140 clears the wheels 80. The recurve region 152 further provides a more rigid structure to the foot bar 140 than a simple straight right angle bend between the leg and foot bar portions. At each distal end of the leg portions 142 and 144 is a transverse bearing sleeve 154. An pivot pin 156 is fastened through the sleeve 154 into a threaded central bore 160 in one of the support brackets 150. A spring loaded stop pin 158 is fitted through a corresponding bore through each of the leg portions 142 and 144 spaced above the pivot sleeve 154. This stop pin 158 is used to adjust the vertical position of the foot bar portion 146 of the bar 140 as more fully described below.

Figure 6:
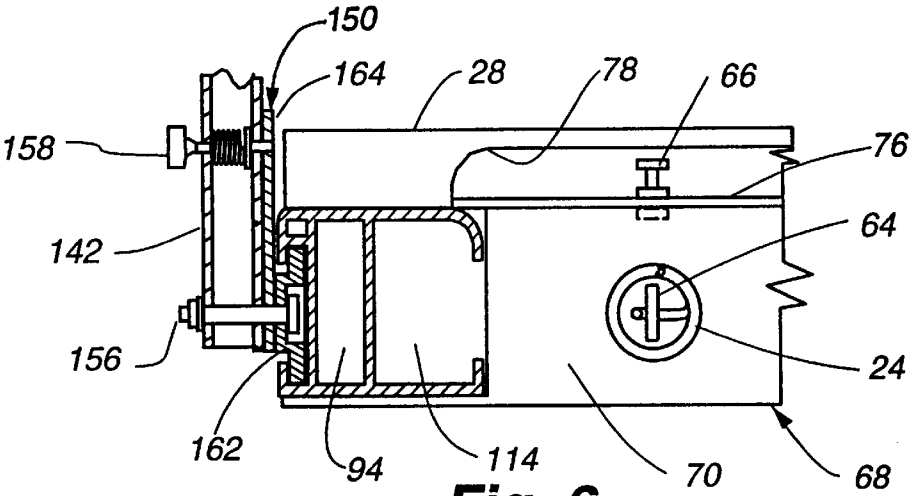
FIG. 6 is a sectional view of the apparatus shown in FIG. 3 taken along the line 6—6 in FIG. 3.

The support brackets 150 are separately shown in FIG. 12 and in installed sectional view in FIG. 6. Each of the support bracket assemblies comprises an elongated anchor bar 162 having a generally T shaped cross section sized complementary to the T slot 110 in the extrusion 88 so that the anchor bar 162 can slide back and forth in the T slot 110. Fastened to the base of the T shaped cross section of the anchor bar 162 is a support plate 164 having an elongated base portion 166 extending along the base of the anchor bar 162 and an arcuate portion 168 extending parallel to the top of the anchor bar 162. This arcuate portion 168 has a series of holes 170 spaced at different angles from the central bore 160 which extends through both the arcuate portion and the anchor bar 162. The holes 170 are positioned to receive the spring loaded stop pin 158 to lock the position of the foot bar 140 at a particular desired height above the rail members 18. At least one of the holes 170 is directly above the central bore 160 providing a vertical position of the foot bar 140. Another of the holes 170 is horizontally aligned with the central bore 160 to completely collapse the foot bar 140 around the foot end 16 of the frame 12.

At the other end of the base portion 166 of the support plate 164 is a through bore 172 which is aligned with and passes through the anchor bar 162. This bore 172 receives a spring loaded stop pin assembly 174. The pin of the stop pin assembly 174 selectively fits into one of a plurality of horizontally spaced apart holes through longitudinal rib 90 of the extrusion 88 of rail member 18. The anchor bar 162 of the foot bar assembly 26 slides along in the T slot 110. The spring loaded stop pin assembly 174 stops the anchor bar 162 at a desired position alone the rail member 18.

Figure 3:
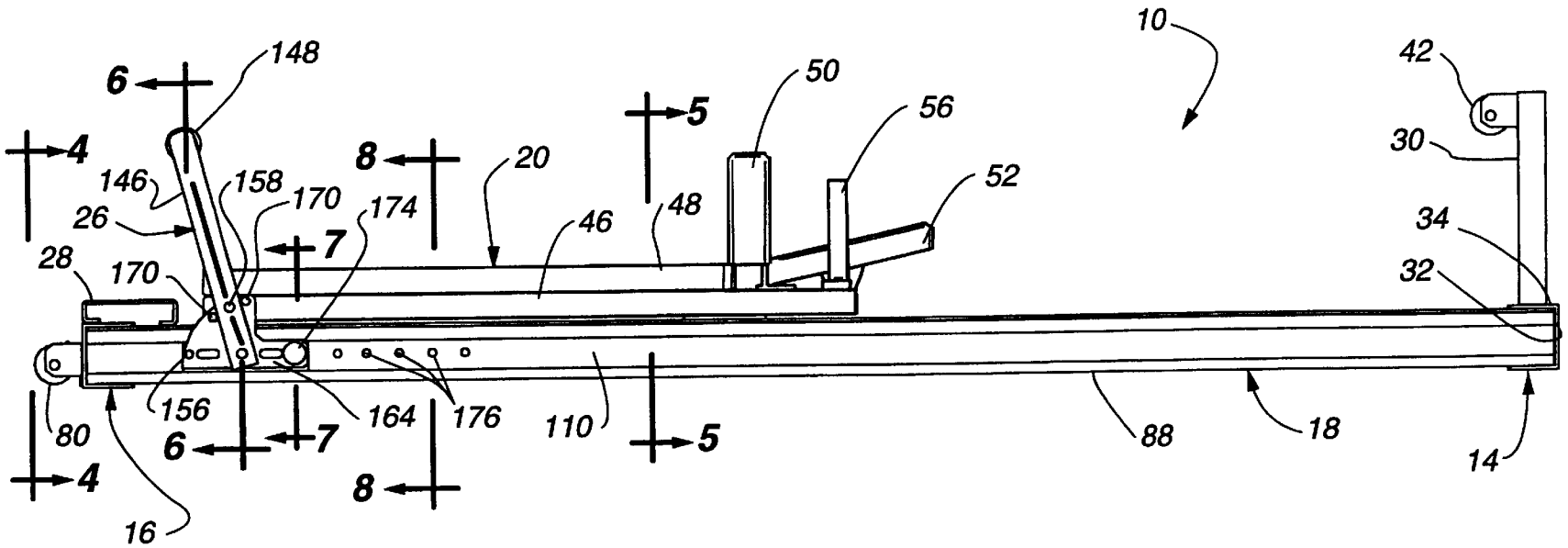
FIG. 3 is a side view of the reformer exercise apparatus shown in FIG. 1 and 2 with the carriage shown fully relaxed and retracted against the foot end of the frame.

The foot bar assembly 26 may be adjusted to any of the several longitudinal positions adjacent the foot end 16 of the frame 12 as indicated by the position of the holes 170 in FIGS. 1–3. In addition, the foot bar assembly 26 may be positioned with the anchor bar 162 fully against the foot end of the foot end extrusion 68. In this position, as is shown in FIG. 10, the foot bar assembly 26 may be used to support the upper portion of the removable jump board 84.

The apparatus in accordance with the present invention may also be configured to be taken apart and transported easily by car. In the second embodiment 200 of the invention shown in FIGS. 9 and 10, the take down version of the apparatus is shown. The apparatus 200 is identical to apparatus 10 described above, except that the rail members 18 are sectioned into two separate in line sections 18*a* and 18*b*. Thus the numbering and configuration of the remainder of the apparatus 200 corresponds to that described above with reference to the first embodiment 10 and thus will not be repeated.

Figure 9:
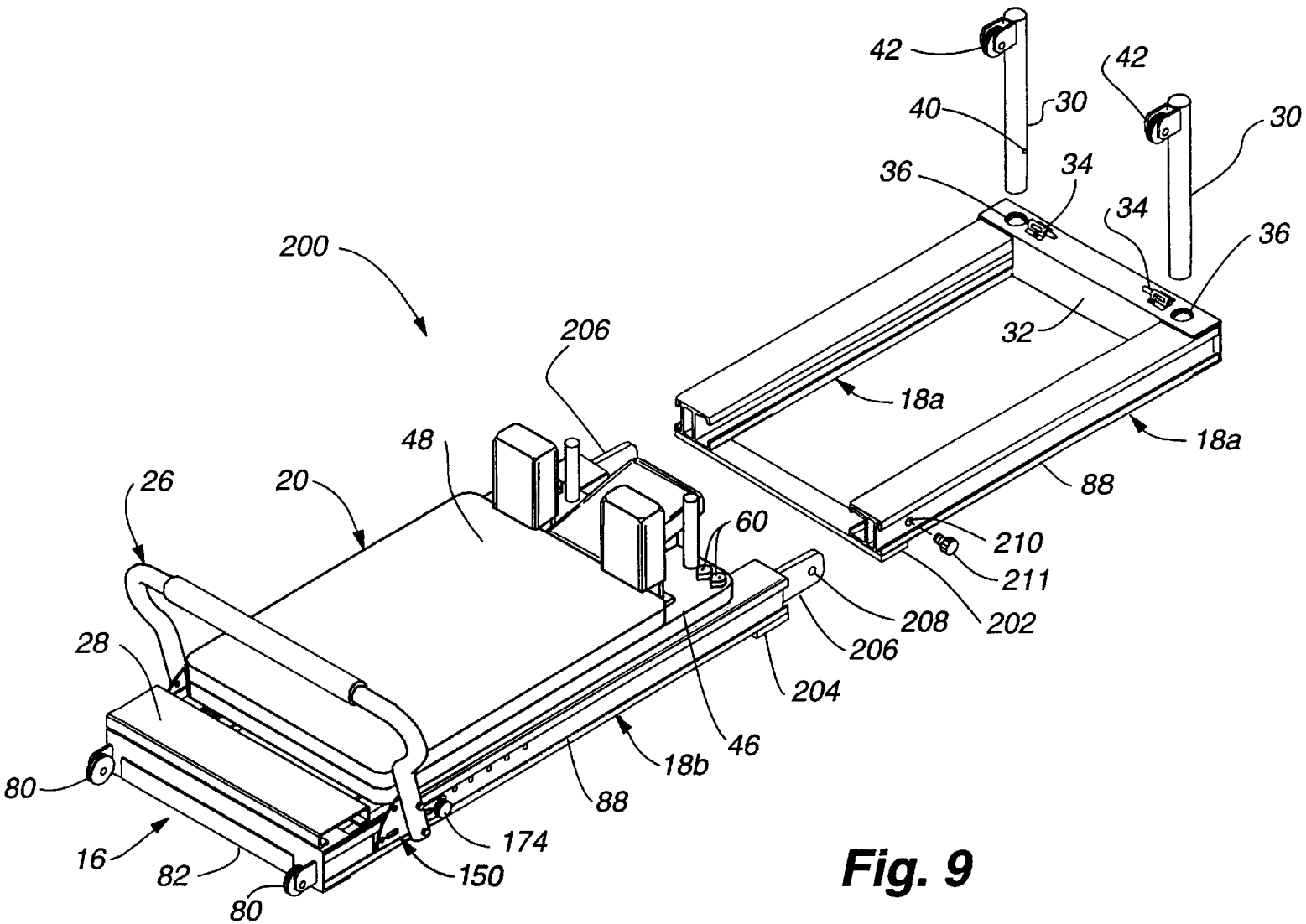
FIG. 9 is a perspective exploded view of a second embodiment of the reformer apparatus in accordance with the present invention.
Figure 10:
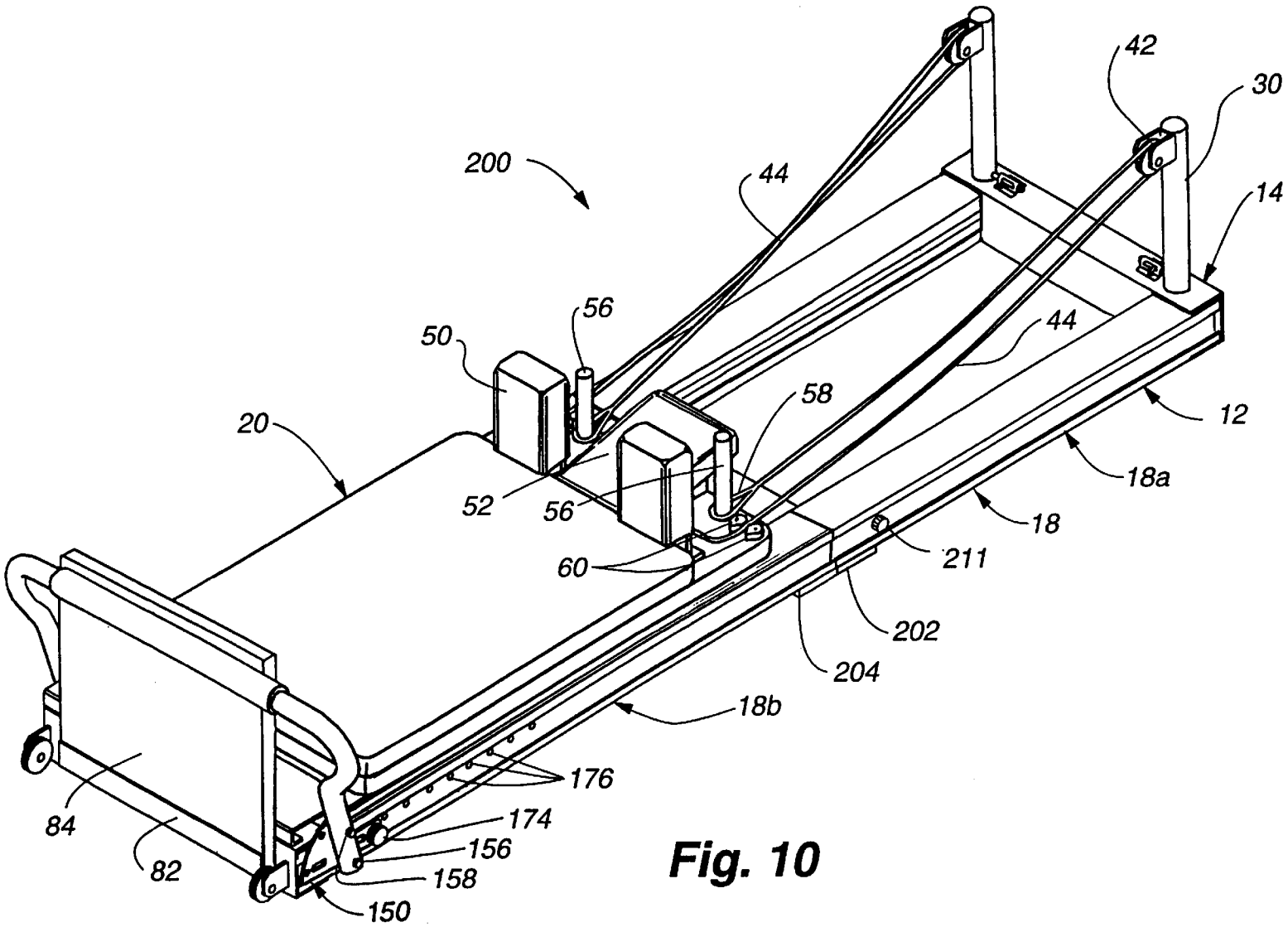
FIG. 10 is an assembled perspective view of the second embodiment of the reformer apparatus in accordance with the present invention.

The apparatus 200 is shown in an exploded view in FIG. 9 and an assembled view in FIG. 10. Each of the middle ends of the rail members 18*a* are joined with the other by a horizontal end plate 202. Each of the middle ends of the rail members 18*b* are similarly joined with the other by a horizontal end plate 204. These end plates 202 and 204 rigidify the rail structure. An elongated bayonet type tongue 206 extends from the mid section 94 of the rail member 18*b*. This tongue 206 is sized to slip into the mid section 94 of the rail member section 18*a*. The tongue 206 has a transverse bore 208 therethrough which aligns with a corresponding hole 210 through the outer longitudinal rib 90 of the extrusion 88 of rail member section 18*a* when the sections 18*a* and 18*b* are fully mated. The transverse bore 208 is preferably threaded. When the two sections are joined, a threaded anchor bolt 211 may be hand tightened in the transverse bore 208 through the hole 210 to fasten the assembled apparatus 200 together. For transport, one simply unbolts the two halves, collapses the foot bar assembly 26 around the foot end 16, removes the arm members 30 from the sockets 36, and places the two sections in one's vehicle. Alternatively, the tongues 206 may include a hinged portion (not shown) which permits the two sections 18*a* and 18*b* to be pulled apart and then folded for transport.

A third embodiment 300 of the exercise apparatus in accordance with the present invention is shown in FIGS. 13 through 16. In these drawings, like numerals are used to identify like components previously described and shown above. The exercise apparatus 300 is similar to the first and second embodiments 10 and 200 described above and shown in FIGS. 1 through 10 except that in this embodiment the posts 56 have been removed, the shoulder stops 50 are removable and permit lateral selection of shoulder stop spacing between two positions, the head end and foot end of the frame 302 are constructed of the same extrusion as the side rails 18, and the foot bar 303 is removable from pivoting support members 304 or "spuds" fastened to the support bracket 164 so that different shapes of foot bars may be utilized. Finally, the removable shoulder stops 50 are stored on a bracket on the inner face of the head end and the arm posts 30 are stored in bores through the head end so that the posts 30 extend into the support channel 114 of the rail 18. These storage features result in an apparatus, prepared for storage, which is only about 5½ inches high and permits a number of the apparatuses to be compactly stacked, one on another, while keeping all of the components of each apparatus together.

Figure 13:
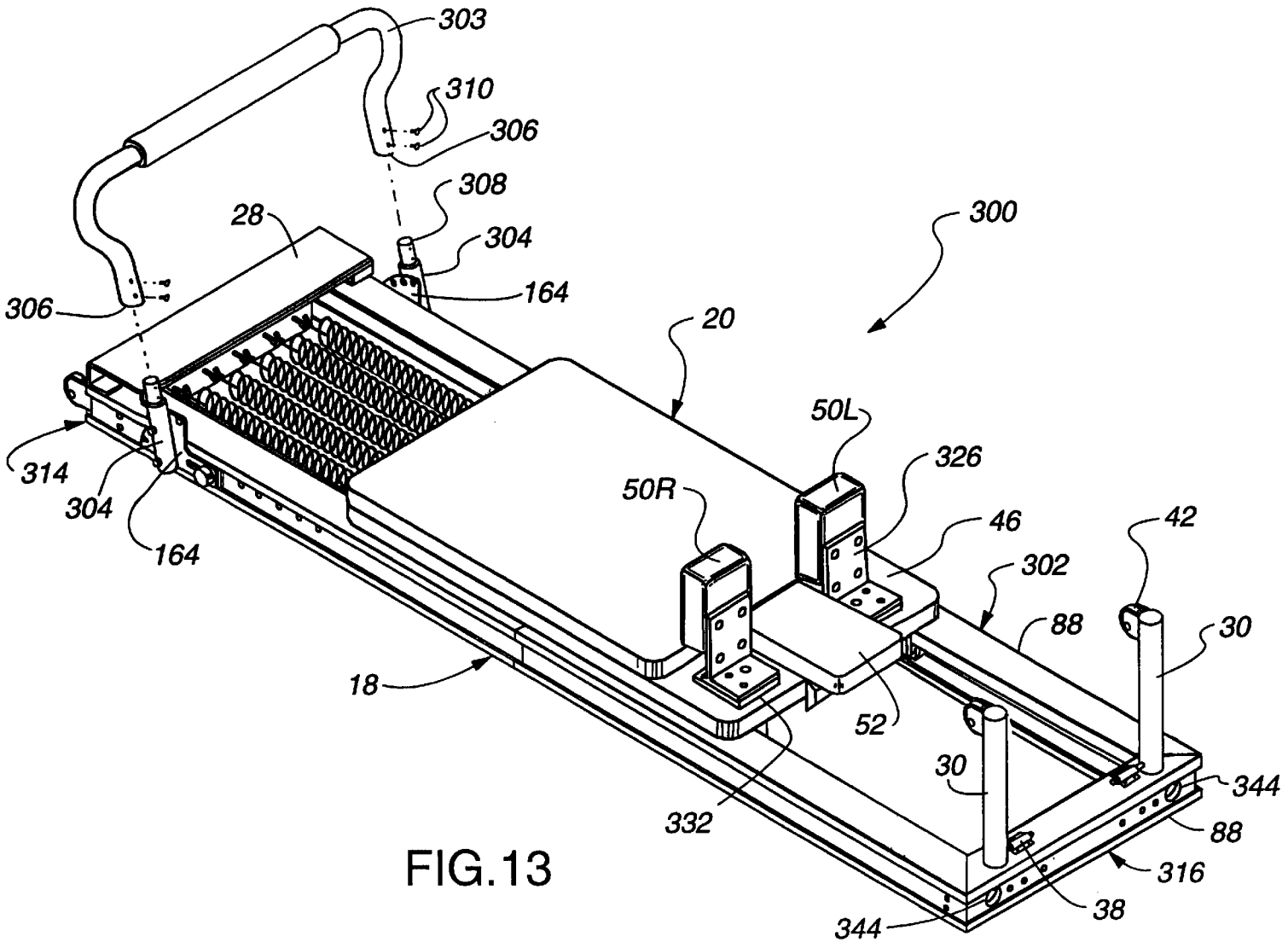
FIG. 13 is a perspective view of a third embodiment of the exercise apparatus in accordance with the present invention.

Referring now to FIG. 13, a perspective view of exercise apparatus 300 is shown with the foot bar 303 shown separated from the support members 304. Each of the foot bar support members 304 is in turn fastened to one of the foot bar support plates 164 as above described. The foot bar 303 has two parallel legs which form sockets 306 which telescopically slide over and onto the free ends 308 of the foot bar support members 304. A pair of set screws 310 are used to fasten the foot bar 303 securely to the support members 304.

Figure 16:
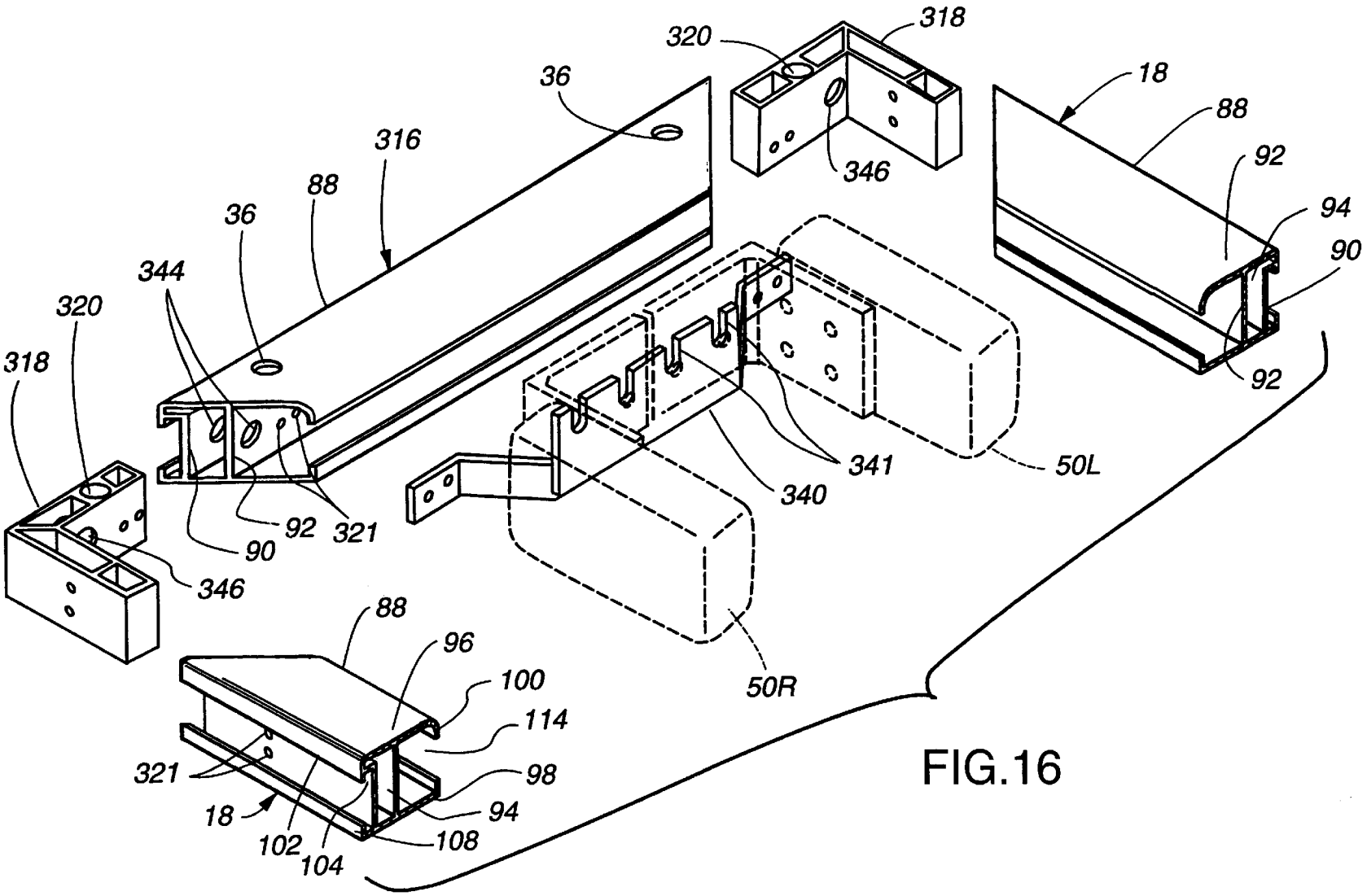
FIG. 16 is an enlarged exploded view of the head end of the frame of the exercise apparatus in accordance with the third embodiment of the present invention showing the miter clamp arrangement for fastening the rails and end members together.

The exercise apparatus 300 includes a frame 302 made of four sections of metal extrusion 88 as in the rail members 18 of embodiments 10 and 200 described above. Each extrusion 88 forming the rail members 18, the foot end member 314 and the head end member 316 have a cross section as shown in FIG. 16, similar to that shown in the cross sectional views in FIGS. 5–8. Again, the extrusions 88 each have a pair of spaced upright longitudinal ribs 90 and 92 forming a closed box mid section 94 between a generally flat top wall 96 and a generally flat bottom wall 98. The top wall 96 extends inward and ends in a downward extending curved portion 100. The top wall 96 further extends horizontally outward and bends downward forming a vertical upper outer wall 102. In this embodiment, the longitudinal gusset 104 between the first rib 90 and the upper outer wall 102 does not form a closed box channel 106 extending parallel to the mid section 94 as in the first two embodiments. The longitudinal gusset 104 reinforces the upper outer wall 102 and, in this particular embodiment 300, connects the upper end of the rib 90 to the outer wall 102, as the formation of the small, closed box channel 106 as in the first two embodiments by extending the rib 90 to the underside of the top wall 96 unnecessary to maintain the requisite strength and rigidity required of the extrusion 88 for its intended use.

The bottom wall 98 extends horizontally outward to a longitudinally extending vertical lower outer wall 108. The outer wall 108 is vertically aligned with the upper outer wall 102. The top wall 96, bottom wall 98, upper outer wall 102 and lower outer wall 108 together form a longitudinally extending modified C shaped channel outer section extending parallel to the mid section 94. This outer section also may be viewed as forming a shallow, longitudinally extending "T" shaped slot 110. The bottom wall 98 also extends horizontally inward from the mid section 94 to a vertical inner wall 112 which is vertically aligned with the end of the curved end 100 of the top wall 96 of the extrusion 88 to form a modified C shaped inner section forming support/guide channel 114 which opens opposite to the C shaped outer section or slot 110. The support/guide channel 114 receives the wheel assemblies 22 in the rail members 18.

In the head end member 316, the top wall 96 has vertical bores 36 therethrough which open into the box mid section 94. These bores 36 receive the bottom ends of the arm posts 30. FIG. 16, an exploded view of the head end of the apparatus 300, illustrates the joinder of the rail members 18 to the head and foot end members 314 and 316. Although only the head end 316 is shown, it is to be understood that the foot end 314 is similarly structured and assembled in the same manner. The ends of the extrusions 88 are mitered at 45 degrees and are joined by use of an L shaped extruded joint member 318. Joint member 318 has cross sectional outer dimensions of each leg complementary to the dimensions of the mid section 94 of the head end member 316 and the rail member 18 such that when the legs of the joint member 318 are inserted into the mid sections 94 of the rail member 18 and the head end member 316, an extremely rigid and accurate joint is formed. The joint member 318 has a vertical bore 320 therethrough at the location of the bore 36 through the top wall 96 of the head end extrusion. Thus, when the frame is fully assembled, and an arm support 30 is inserted through the bore 36, the lower end of the arm support 30 passes through the bore 320 in the leg of the joint member 318 forming a secure base for the arm support. Optionally, in this embodiment 300, the lock pins 38 may be included on the top of the extrusion 88 or omitted. If desired, the lock pins 38 may be replaced by a through pin arrangement passing horizontally through the ribs 90 and 92, the joint member 318, and the base of the arm member 30.

The foot end member 314 and the head end member 316 are joined to the rail members 18 with the four joint members 318. After assembly of each corner, a pair of screws (not shown) are inserted through appropriate apertures 321 in the vertical rib 90 and in the vertical rib 92 of the extrusions 88 adjacent the ends of each extrusion to rigidly fasten the head and foot ends 316 and 314 to the joint members 318 and thus to the rails 18 and form the rigid frame 302.

The rails 18 may be formed in two separable sections for portability of the apparatus in the trunk of a car as in the second embodiment 200 as is shown in FIGS. 9 and 10. In this instance, brace plates 202 and 204 would preferably be fastened to the undersides of the bottom walls 98 of the extrusions 88 to make the two sections rigid and eliminate the potential for application of excessive stresses on the corners and the joint members 318 therein.

Figure 14:
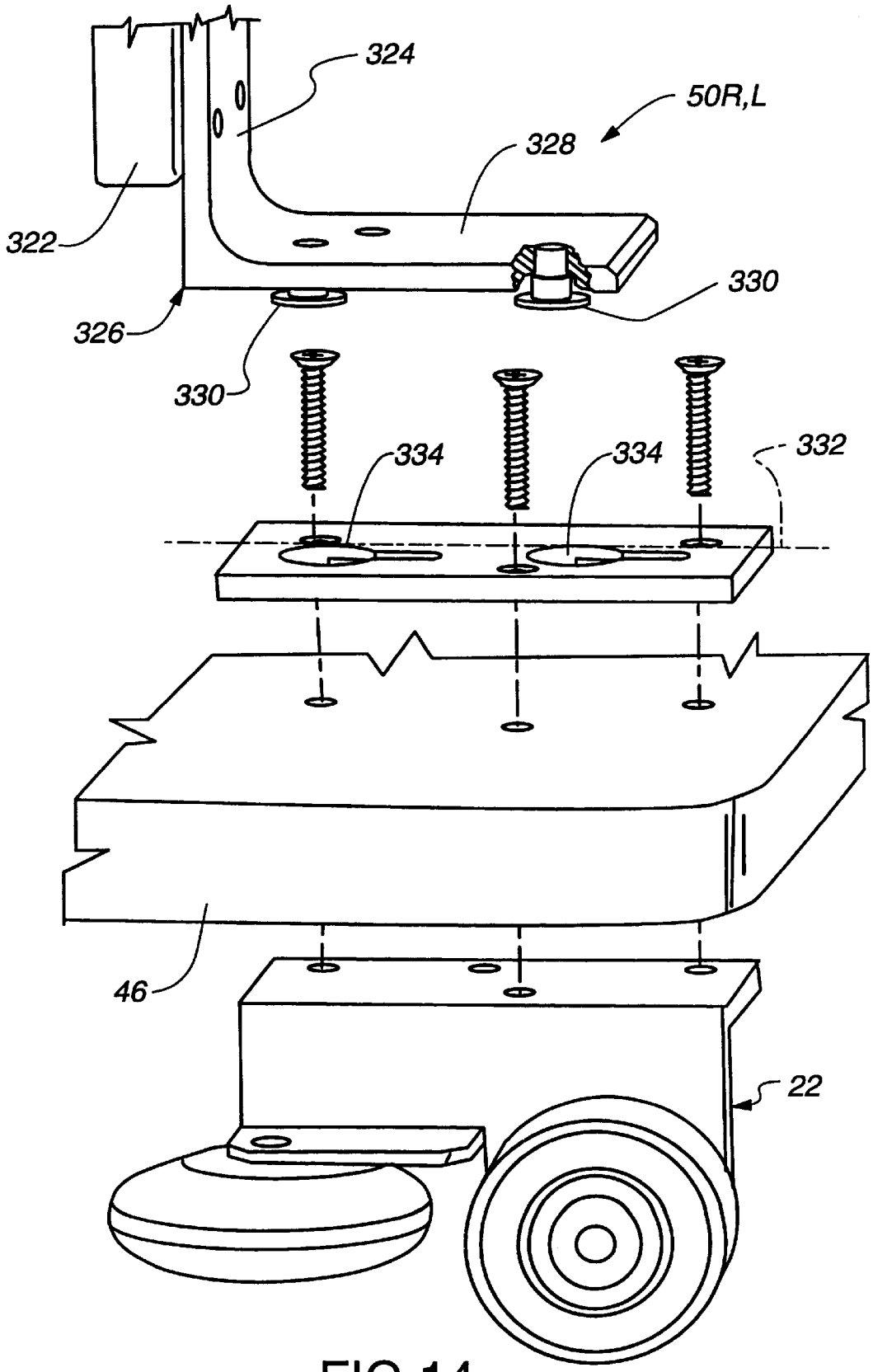
FIG. 14 is an exploded enlarged view showing the mounting arrangement of one of the removable shoulder stops in the third embodiment in accordance with the invention.

Referring now to FIG. 14, the mounting arrangement of the shoulder stops 50R and 50L in accordance with this embodiment of the invention is shown. Each shoulder stop 50 comprises a cushion pad 322 fastened to one side of one leg 324 of an angle bracket plate 326. The other leg 328 of the angle bracket plate 326 has a pair of bayonet pins 330 protruding from its underside. These pins 330 are each laterally spaced to one side of the longitudinal center line of the shoulder stop 50. A complementary rectangular mounting plate 332 is fastened to the upper surface of the carriage platform 46. This mounting plate 332 has a pair of keyway slots 334 formed therein, also spaced to the same side of the longitudinal centerline of the leg 328 of the bracket plate 326, and spaced to receive the bayonet pins 330 therein. The right shoulder stop 50R shown in FIG. 13 has its bayonet pins spaced to the right of the centerline of the angle bracket plate 326. The left shoulder stop 50L shown in FIG. 13 has its bayonet pins spaced to the left of the centerline of the angle bracket plate 326. Consequently, if the shoulder stops 50R and 50L are swapped, the spacing between them will increase. Conversely, if the mounting plates 332 were reversed on carriage platform 46, then, if the shoulder stops 50R and 50L were swapped, the alternative arrangement would produce a narrower spacing therebetween. Accordingly, the user may select a choice between normal lateral spacing and wide lateral spacing with one arrangement of the mounting plates 332, and may alternatively select a choice between normal lateral spacing and narrow lateral spacing by simply swapping the mounting plate locations on the platform 46.

The shoulder stops 50R and 50L and the arm posts 30 preferably are removed and stored when the apparatus 300 is not in use. To prevent interchanging shoulder stops and/or loss of the shoulder stops while the unit is stored, a sheet metal bracket 340, best shown in FIG. 16, is fastened to the inside vertical rib 92 of the extrusion 88 of the head end member 316. This bracket 340 has four U shaped slots 341 along its upper edge to receive the bayonet pins 330 so that the shoulder stops 50 can be removed from the plate 332 and stored as shown by the dashed lines in FIG. 16 and in the side view of FIG. 15.

Figure 15:
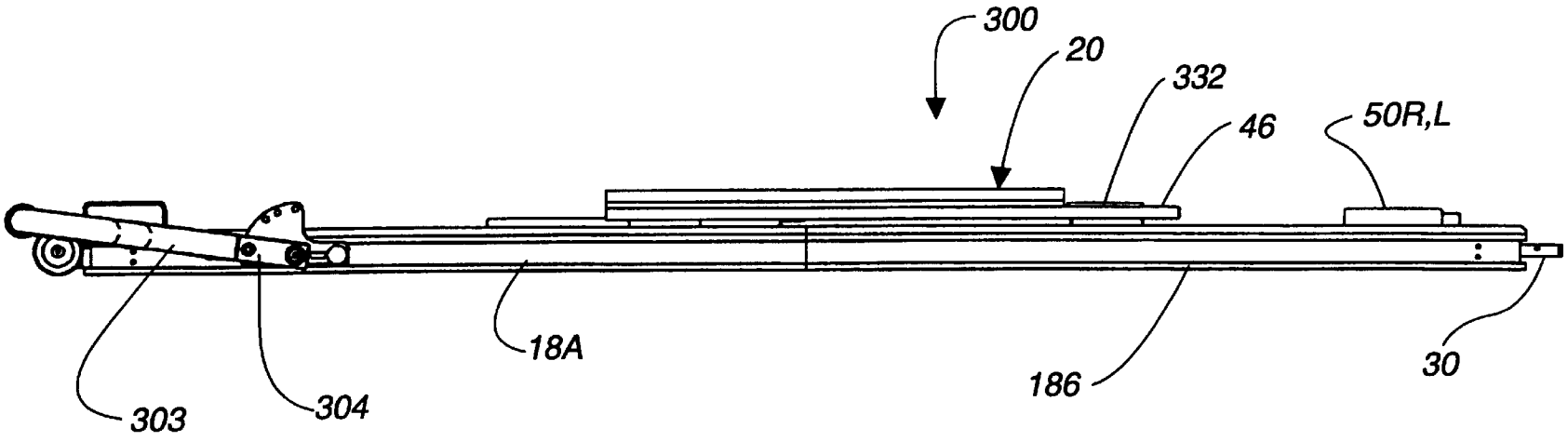
FIG. 15 is a side view of the third embodiment shown in FIGS. 13 and 14 with the shoulder stops and arm posts in storage positions.

The arm posts 30 are also stored in the head end 316 as shown in FIG. 15. The extrusion 88 of the head end member 316 also has a pair of spaced horizontal bores 342 and 344 through both the vertical ribs 90 and 92 and joint member 318 has a horizontal bore 346 therethrough, spaced from the ends of the extrusion such that the bores 342, 344, and 346 are aligned in the head end member 316 when the frame is assembled. The arm posts 30, when pushed through the bores 342, 344 and 346, extend into and along the support channels 114 of the rails 18. The pulleys 42 prevent the arm posts from passing entirely into the support channels 114.

Alternatively, a clip may be provided (not shown) in the support channels 114 to hold the arm posts in place.

Finally, the exercise apparatus 300 may be stored either vertically or horizontally. With the parts stored as shown in FIG. 15, a number of apparatuses may be stacked together. Alternatively, the foot bar 303 may be raised to the second hole in the bracket 164 and the apparatus propped vertically, supported by the foot bar 303 and the wheels 80.

The present invention may be practiced otherwise than as specifically described and shown above. Many changes, alternatives, variations, and equivalents to the various structures shown and described will be apparent to one skilled in the art. For example, the apparatus may be constructed of a different metal than aluminum. The support rollers 122 and guide rollers 124 may be shaped differently than that shown. The guide rollers 124 may optionally be omitted. The wheel support bracket 116 may be machined, cast or formed of sheet metal. The arm members 30 may be conveniently stored entirely, when removed from the sockets 36, in clips installed in the support guide channels 114 near the head ends 14 or 316. The latch pin assemblies 38 may be different than those shown, or omitted entirely. The pulley assemblies 42 may be fastened to the arms 30 so as to be adjustable in height above the head end 14. The frame 12 may be positioned substantially above a floor by upright supports fastened to the underside of the bottom wall 98 of the rail members 18. Specifically in the third embodiment 300, the foot bar 303 may be replaced with one having a different shape, such as a narrower foot bar or a platform which has appropriately spaced legs, or a flattened foot bar arrangement with ends adapted to fit onto the supports 304. Accordingly, the invention may be practiced other than as specifically described and shown herein with reference to the illustrated embodiments. The present invention is not intended to be limited to the particular embodiments illustrated but is intended to cover all such alternatives, modifications, and equivalents as may be included within the spirit and broad scope of the invention as defined by the following claims. All patents, patent applications, and printed publications referred to herein are hereby incorporated by reference in their entirety.

What is claimed is:

1. An exercise apparatus comprising:

a generally rectangular frame having a head end and a foot end and including a pair of spaced apart parallel rail members forming part of said frame, wherein each said rail member, said head end and said foot end is comprised of an aluminum extrusion having a top wall, a bottom wall, and a pair of spaced longitudinal vertical ribs between said top wall and said bottom wall and forming a hollow longitudinally extending mid portion therebetween, a longitudinal T shaped outer slot formed between said top and bottom wall and an outer one of said vertical ribs, and a support channel formed between said top wall, said bottom wall, and said inner vertical rib, said ends and rail members being joined by a right angle member having each leg extending into the hollow mid portion of one said end or one of said rail members to form a mitered corner;

a movable carriage mounted on said frame for movement along said rail members between said head and foot ends, said carriage having a generally flat upper surface, a pair of spaced shoulder stops mounted to said upper surface and a head rest extending toward said head end from said upper surface of said carriage and a plurality of support and guide wheel assemblies mounted to an underside of said carriage, each of said wheel assemblies including a support roller mounted for rotation about a horizontal axis, each said support roller being carried within said support channel of one of said rail members.

2. The exercise apparatus according to claim 1 further comprising an adjustable foot bar assembly adjustably mounted to said rail members adjacent said foot end of said frame.

3. The apparatus according to claim 2 wherein said foot bar assembly comprises a support bracket assembly and a generally U shaped foot bar having a straight foot bar portion and a pair of leg portions.

4. The apparatus according to claim 1 wherein each of said wheel assemblies includes a guide roller mounted for rotation about a vertical axis.

5. The apparatus according to claim 4 wherein each of said guide rollers extends into said support channel.

6. The apparatus according to claim 5 wherein each said guide rollers rolls against said inner vertical rib forming said support channel to maintain alignment of said carriage between said rail members.

7. The apparatus according to claim 1 wherein each of said wheel assemblies is captured within a portion of one of said rail members.

8. An exercise apparatus comprising:

a generally rectangular frame having a head end, a foot end and a pair of spaced apart parallel rail members therebetween, each of said rail members including an outwardly open T shaped longitudinal slot therein;

a movable carriage mounted on said frame for movement along said rail members between said head and foot ends, said carriage having a generally flat upper surface, a pair of spaced shoulder stops mounted to said upper surface and a head rest extending toward said head end from said upper surface of said carriage;

a plurality of elongated elastic members extending between said carriage and said foot end of said frame; and a foot support assembly mounted to said frame near said foot end comprising a U shaped foot bar having a pair of spaced parallel leg portions forming open sockets at their ends adapted to telescopically mate onto a complementary elongated cylindrical support member, each support member having a pivot pin sleeve extending transversely therethrough each adjacent a lower end of each said support member, each support member being fastened to a support bracket assembly, each said bracket assembly having an elongated anchor bar member slidably disposed in said slot in said rail member.

9. The apparatus according to claim 8 wherein said anchor bar member has a T shaped cross section complementary to said T shape of said slot in said rail member.

10. The apparatus according to claim 9 wherein said support bracket assembly further comprises a vertically oriented foot bar support plate fastened to said anchor bar member having an elongated base portion and an arcuate portion.

11. The apparatus according to claim 10 wherein said base portion of said foot bar support plate has a pivot pin bore therethrough receiving a pivot pin fastening one of said legs to said anchor bar through said pivot pin sleeve for rotation of said foot bar about said pivot pin.

12. The apparatus according to claim 11 wherein each said leg portion includes a stop pin extending through said leg portion and spaced from said pivot pin.

13. The apparatus according to claim 12 wherein said arcuate portion has a plurality of holes therethrough along an outer edge thereof spaced at different angles from said pivot pin.

14. The apparatus according to claim 13 wherein one of said holes is horizontally aligned with said pivot pin.

15. The apparatus according to claim 11 wherein said base portion further includes a spring loaded stop pin extending therethrough and through said anchor bar member, said stop pin adapted to engage one of a plurality of apertures in said slot in said rail member to position said foot bar assembly at selectable positions along said rail members.

16. The apparatus according to claim 8 wherein each of said rail members and said head end and said foot end comprises an elongated extrusion having a top wall, a bottom wall, and a pair of spaced longitudinal vertical ribs between said top wall and said bottom wall and forming a hollow longitudinally extending mid portion therebetween, a longitudinal T shaped outer slot formed between said top and bottom wall and an outer one of said vertical ribs, and a carriage support channel formed between said top wall, said bottom wall, and said inner vertical rib.

17. The apparatus according to claim 16 wherein said carriage further includes a plurality of support and guide roller wheel assemblies fastened to an underside of said carriage and positioned to support said carriage on said rail members.

18. The apparatus according to claim 17 wherein each of said wheel assemblies includes a support roller captured within a portion of one of said rail members.

19. The apparatus according to claim 18 wherein each of said wheel assemblies includes a support roller wheel rotatable about a horizontal axle and a guide roller rotatable about a vertical axle.

20. The apparatus according to claim 19 wherein said carriage further comprises a pair of spaced removable shoulder stops each removably fastened to an upper surface of said carriage via at least one bayonet pin engaged in a complementary shaped slotted keyway in a shoulder pad support plate on said carriage.

21. The apparatus according to claim 20 wherein each shoulder stop has a pair of bayonet pins engaging a corresponding pair of keyways in said shoulder stop support plate and said bayonet pins and said keyways are spaced laterally to one side of a longitudinal centerline of said shoulder stop.

22. An exercise apparatus comprising:

a generally rectangular frame having a head end and a foot end and including a pair of spaced apart parallel rail members forming part of said frame, wherein each of said rail members and said head end and said foot end is an extrusion having an identical cross sectional shape; and a movable carriage mounted on said frame for movement along said rail members between said head and foot ends, said carriage having a generally flat upper surface, a pair of spaced shoulder stops mounted to said upper surface and a head rest extending toward said head end from said upper surface of said carriage and a plurality of support and guide wheel assemblies mounted to an underside of said carriage, each of said wheel assemblies including a support roller mounted for rotation about a horizontal axis and riding on a portion of one of said rail members.

23. The apparatus according to claim 22 wherein each of said rail members comprising a pair of rail member sections removably joined together by a tongue member extending from one section into an adjacent section.

24. The apparatus according to claim 22 wherein said extrusion has a central closed box section, and inner channel section, and an outer T shaped slot section formed by a top wall, a bottom wall, and a pair of spaced vertical ribs between said walls.

25. The apparatus according to claim 24 wherein each of said rail members is joined to one of said head or foot members by an L shaped joint member having a cross sectional shape complementary to that of said closed box section of said extrusion.

26. The apparatus according to claim 25 wherein said joint member is an extruded metal body.

* * * * *